US010596435B2

(12) United States Patent
White et al.

(10) Patent No.: US 10,596,435 B2
(45) Date of Patent: Mar. 24, 2020

(54) BASKETBALL TRAINING DEVICE FOR THE GUIDE HAND

(71) Applicants: Robert M. White, Durham, NC (US); Krista J. Gingrich-White, Durham, NC (US)

(72) Inventors: Robert M. White, Durham, NC (US); Krista J. Gingrich-White, Durham, NC (US)

( * ) Notice: Subject to any disclaimer, the term of this patent is extended or adjusted under 35 U.S.C. 154(b) by 0 days.

(21) Appl. No.: 16/250,020

(22) Filed: Jan. 17, 2019

(65) Prior Publication Data

US 2019/0275399 A1 Sep. 12, 2019

Related U.S. Application Data

(60) Provisional application No. 62/639,686, filed on Mar. 7, 2018.

(51) Int. Cl.
*A63B 69/00* (2006.01)

(52) U.S. Cl.
CPC ..... *A63B 69/0059* (2013.01); *A63B 69/0071* (2013.01); *A63B 2243/0037* (2013.01)

(58) Field of Classification Search
CPC ..... A63B 69/00; A63B 69/36
See application file for complete search history.

(56) References Cited

U.S. PATENT DOCUMENTS 3,339,926 A * 9/1967 Coupar ..... A63B 69/0059 473/214
3,581,312 A 6/1971 Nickels
3,707,730 A 1/1973 Slider
4,377,284 A 3/1983 Okerlin
4,383,685 A 5/1983 Bishop
4,575,089 A * 3/1986 Corbett ..... A63B 69/0059 473/214
4,738,447 A 4/1988 Brown
4,919,425 A 4/1990 Wolf
5,135,217 A * 8/1992 Swain ..... A63B 69/0071 473/450
5,149,085 A 9/1992 Sanchez
5,188,356 A 2/1993 Furr
5,228,682 A 7/1993 Wolf
5,320,342 A 6/1994 Houck
(Continued)

*Primary Examiner* — Eugene L Kim
*Assistant Examiner* — Christopher Glenn
(74) *Attorney, Agent, or Firm* — Law Office of Robert M. White, PLLC

(57) ABSTRACT

This is a basketball training device for a user's guide hand comprising upper arm, pivot, forearm, thumb, and finger components. The pivot component is pivotably connected to the upper arm component and rigidly coupled to the forearm component, and the forearm component is rigidly coupled to both the thumb component and the finger component. The upper arm, forearm, thumb, and finger components are each secured to the user's upper arm, forearm, thumb, and at least one finger, respectively. As such, the basketball training device not only restricts flexion and opposition of the thumb but it restricts pronation of the user's forearm. In addition, the basketball training device restricts flexion, extension, radial deviation, and ulnar deviation of the user's wrist while allowing the user appropriate extension at the elbow joint during the entire shooting motion.

8 Claims, 9 Drawing Sheets

(56) References Cited

U.S. PATENT DOCUMENTS

| | | | | |
|---|---|---|---|---|
| 5,472,206 | A * | 12/1995 | Manley | A63B 69/0059 128/881 |
| 5,651,743 | A | 7/1997 | Stephan | |
| 6,095,936 | A | 8/2000 | Kirkpatrick | |
| 6,203,453 | B1 | 3/2001 | Coddens | |
| 6,283,877 | B1 | 9/2001 | Cook | |
| 7,172,522 | B1 | 2/2007 | Harvey | |
| 7,399,240 | B2 | 7/2008 | Paukert | |
| 7,442,133 | B2 | 10/2008 | Wolf | |
| 7,771,293 | B1 | 8/2010 | Vann | |
| 7,775,898 | B1 * | 8/2010 | Allen | A63B 69/0059 473/207 |
| 7,789,763 | B1 * | 9/2010 | Smith | A63B 69/3608 473/212 |
| 8,052,546 | B1 | 11/2011 | Nagel | |
| 8,425,339 | B2 * | 4/2013 | Basden | A41D 19/01588 473/201 |
| 9,545,556 | B2 | 1/2017 | Mohammed | |
| 2007/0270248 | A1 | 11/2007 | Ffrench | |
| 2011/0230283 | A1 | 9/2011 | Hougen | |
| 2017/0319935 | A1 | 11/2017 | Griffee | |

* cited by examiner

BASKETBALL TRAINING DEVICE FOR THE GUIDE HAND

CROSS-REFERENCES TO RELATED APPLICATION

This application claims the benefit of provisional patent application Ser. No. 62/639,686 filed Mar. 7, 2018 on behalf of the present inventors.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not Applicable.

BACKGROUND OF INVENTION

1. Field of Invention

The present invention relates to the field of basketball training aids. More specifically, this invention is in the field of basketball shooting aids that are used for proper positioning and movement of the user's guide hand.

2. Description of Related Art

Becoming an accurate basketball shooter requires an athlete to exercise proper mechanics, which are reinforced by consistent repetition. Proper mechanics for shooting a basketball involve, in large part, an athlete's stance and proper alignment of the shooting hand and basketball with respect to the basketball rim. Because a basketball is shot with only one hand, which is typically an athlete's dominant hand, a lot of emphasis is placed on proper vertical alignment of the shooting shoulder, shooting elbow, and shooting hand.

While significant attention to this alignment is important, the mechanics of the off-hand, or guide hand, are equally important. Too often, though, an athlete focuses significant attention on the mechanics of the shooting hand, but neglects to reinforce those of the guide hand. As a result, an athlete may tend to shoot with both hands, which can resemble more of a pushing of the basketball towards the basketball rim. Alternatively, an athlete may generally shoot with only his or her shooting hand, but the thumb of the guide hand will come through towards the basket with the release of the basketball, affecting its trajectory and spin, leading to inconsistent and inaccurate shooting.

A variety of basketball shooting aids have been developed over the years, a majority of these training aids being directed almost exclusively to the mechanics of the shooting hand. U.S. Pat. No. 4,383,685 describes one such training aid. This training aid comprises an arcuate guide secured to a vest worn by the athlete and an elbow sleeve linked to the guide. Being linked to the guide, the elbow sleeve restricts movement of the athlete's shooting elbow along a prescribed plane that is in alignment with the basketball rim. However, this aid does nothing to ensure proper mechanics of the athlete's guide hand. U.S. Pat. No. 3,707,730 (a glove for the shooting hand that encourages proper hand spacing on the basketball) and U.S. Pat. No. 5,135,217 (a finger harness for the shooting hand that is attached via a strap to an upper arm cuff) are other examples of basketball training aids geared exclusively toward the shooting hand.

A number of patents disclose basketball training aids that couple the movements of the shooting hand and the guide hand. For example, U.S. Pat. No. 8,052,546 discloses a pair of bracelets worn around the wrists of both the user's shooting hand and guide hand. A coupler links the two bracelets together, continuous linkage between the two bracelets during the shooting motion supposedly ensuring proper shooting form. However, as suggested above, the mechanics of the shooting hand and the guide hand are necessarily different and cannot be coupled together in this manner. The shooting hand, in conjunction with the shooting shoulder and shooting elbow, is the only hand that actually shoots the basketball. The shooting shoulder, shooting elbow, and shooting hand move dynamically along a plane that is in perfect vertical alignment with the center of the basketball rim. The guide hand, however, is relatively static throughout the entire shooting motion and serves a limited role of keeping the basketball secure in the shooting hand. As such, the movement of the guide hand must not effect the movement of shooting hand and, thus, necessarily cannot be coupled to the movement of the shooting hand. Other examples of basketball training aids that couple the movements of the shooting hand and the guide hand include U.S. Pat. No. 7,399,240 (a single band encircles both the wrist of the shooting hand and the wrist of the guide hand) and U.S. Pat. No. 4,377,284 (cuffs around both the forearm of the shooting hand and the forearm of the guide hand are strapped together).

A variety of ineffective training aids have been developed that focus attention on the mechanics of only the guide hand during the shooting motion. The aid described in U.S. Pat. No. 4,919,425 comprises a thumb loop attached to a strap. The strap is wrapped over the top of the wrist and around the forearm, where it is then secured to a pair of sleeves positioned on either side of the elbow of the guide hand. When the strap is tightened, movement of the guide hand's thumb relative to the guide hand's elbow is limited. However, while thumb abduction, flexion or opposition may be limited, these movements are not restricted sufficiently to prevent negative effects on the overall shooting motion. In fact, this aid does nothing to prevent pronation of the forearm that, assuming thumb abduction, flexion and opposition are limited, still allows pronation of the wrist joint and subsequent movement of the thumb relative to this joint. In addition, this aid does nothing to prevent flexion, extension, radial deviation, or ulnar deviation of the wrist joint, movements that can negatively affect the overall shooting motion. Lastly, by not sufficiently restricting movement of more than just the thumb of the guide hand, this aid does very little to promote the passive role the guide hand has in the overall shooting motion. U.S. Pat. No. 5,228,682 (eliminates one of the elbow sleeves in the aid just described) and U.S. Pat. No. 7,442,133 (adds a middle finger sleeve that does nothing to limit flexion of this finger and, thus, does not promote the passive role of the guide hand in the overall shooting motion) are separate embodiments developed by the same inventor.

The training aid disclosed in U.S. Pat. No. 5,320,342 comprises a chest strap coupled to a shoulder strap, the shoulder strap being linked to a relatively rigid control rod having a thumb loop. With the thumb of the guide hand inserted through the thumb loop, movement of the thumb is restricted because it is effectively anchored to the chest and shoulder of the user. This ineffective aid has a number of crucial flaws, however. First, the guide hand's thumb is anchored inward relative to the guide hand's shoulder, promoting pronation of the guide hand's forearm. This is the type of movement that must be prevented with respect to the guide hand. In addition, the elbow of the guide hand is unnecessarily restricted so that it cannot extend adequately during the overall shooting motion. Some measure of elbow extension must be allowed to satisfy the role of the guide hand during the overall shooting motion. A similar aid is described in U.S. Pat. No. 6,203,453, although a loop for the index finger is added.

Another example of a training aid geared toward the mechanics of the guide hand is described in U.S. Pat. No. 6,283,877. This aid comprises a belt worn around the user's waist and a band worn around the wrist of the user's guide hand. The band and belt are connected by an assembly of lines or cords, such that the connection restricts forward movement of the guide hand. However, this aid does not prevent abduction, flexion, opposition of the guide hand's thumb, nor pronation of the guide hand's forearm. Further, it does not allow for adequate extension of the guide hand's elbow during the overall shooting motion. In fact, this aid does little to promote proper mechanics of the guide hand and prevent the negative effects improper mechanics have on the overall shooting motion.

In U.S. Pat. No. 5,188,356, a training aid used for the guide hand is described comprising only a wrist strap having a finger loop extension connected to it. In one embodiment, the wrist strap encircles the wrist of the guide hand and the finger loop encircles the thumb of the guide hand. Tension between the wrist strap and the finger loop are presumed to restrict flexion or opposition of the thumb relative to the wrist. Assuming this aid is effective in that regard, it does nothing to prevent pronation of the guide hand's forearm, which results in movement of the thumb relative to the elbow. This aid also does nothing to restrict flexion, extension, radial deviation, or ulnar deviation of the wrist. In an alternate embodiment, the finger strap runs over the top of the thumb and around to loop around the index finger of the guide hand. Still, pronation of the forearm and extraneous movements of the wrist are not restricted, providing little aid to ensuring proper mechanics of the guide hand.

A basketball training glove for the guide hand is disclosed in U.S. Pat. No. 9,545,556 that comprises a glove body, a wrist strap, a thumb strap, a finger strap, and multiple rigid elements. Separate rigid elements, in particular, are positioned on the dorsal side of the guide hand and extend the length of each of the user's fingers. As such, each of the user's fingers are kept straight by an associated rigid element. The thumb, however, is not supported by a rigid element and, instead, is merely strapped tightly against the user's index finger. While finger and thumb movements are restricted with this glove, this invention suffers from the same deficiencies as many of the references cited above in that it does nothing to prevent pronation of the guide hand's forearm or restrict flexion, extension, radial deviation, or ulnar deviation of the wrist. In addition, this glove promotes an unnatural positioning of the guide hand. While it is true that the guide hand must remain relatively passive during the shooting motion, it is not ideal for the guide hand to remain entirely flat during the shooting motion. In other words, the fingers should be splayed comfortably, curving naturally with the circumference of the basketball, and the thumb should be extended and abducted comfortably. In this way, the guide hand can better support the basketball to ensure the basketball stays in place. A flat, rigid hand with a tightly adducted thumb does not provide this level of support.

Because the guide hand serves a limited role, which is primarily to keep the basketball secure in the shooting hand, the proper mechanics of the guide hand help to ensure a fairly static and relatively passive motion. In particular, proper mechanics help to ensure that neither pronation of the guide hand's forearm nor flexion or opposition of the guide hand's thumb occur during the shooting motion. Other movements that should be restricted include flexion, extension, radial deviation and ulnar deviation of the wrist. Ultimately, the palmar surface of the guide hand, which is initially placed on the side of the basketball, must remain parallel to the sagittal plane of the user during the shooting motion. However, extension of the elbow must be allowed, if only in a limited range. By restricting these movements, the guide hand is less likely to negatively effect the trajectory and spin of the basketball or the vertical alignment of the shooting hand, shooting elbow, and shooting shoulder with respect to the center of the basketball rim.

In light of prior art, there remains a need for a single basketball training aid that can accomplish these goals and reinforce the proper mechanics of the guide hand during the entire shooting motion. Such a training aid must promote an overall static and passive motion of the guide hand by restricting extraneous movement of the guide hand wherever possible while still allowing for comfortable and effective use during a variety of basketball shooting drills.

BRIEF SUMMARY OF INVENTION

According to one embodiment, a basketball training device used to promote proper mechanics of the guide hand comprises an upper arm component, a pivot component, a first elongated coupling member, a forearm component, a second elongated coupling member, a thumb component, a third elongated coupling member, and a finger component. Each component, with the exception of the pivot component, is secured to the user's arm or hand by way of adjustable straps so that the upper arm component is secured to the lateral side of the user's bicep, the forearm component is secured to the dorsal side of the user's forearm, the thumb component is secured to the dorsal side of the user's thumb, and the finger component is secured to the dorsal side of at least one of the user's fingers. While adjustable straps are preferred to allow a fit comfortable for any user, other means for securing these components to corresponding positions on the user's arm and hand can be used, such as elastic bands.

The pivot component comprises a gudgeon and a pivot attachment point. The gudgeon is pivotably connected to the upper arm component. The forearm component comprises a proximal forearm attachment point, a first distal forearm attachment point, and a second distal forearm attachment point. The first elongated coupling member, formed from a rigid material (e.g. fiberglass, aluminum, carbon fiber) is attached at a proximal end to the pivot attachment point and at a distal end to the proximal forearm attachment point. As such, the pivot component and the forearm component are rigidly coupled. The thumb component comprises a thumb attachment point and the finger component comprises a finger attachment point. The second elongated coupling member, also formed from a rigid material, is attached at a proximal end to the first distal forearm attachment point and at a distal end to the thumb attachment point. As such, the thumb component is rigidly coupled to the forearm component. The third elongated coupling member, similarly formed from a rigid material, is attached at a proximal end to the second distal forearm attachment point and at a distal end to the finger attachment point. As such, the finger component is rigidly coupled to the forearm component. Because the user's thumb and at least one finger are effectively anchored to the upper arm component, abduction, flexion, and opposition of the thumb is restricted. Pronation of the user's forearm is also restricted.

Once the basketball training device has been secured to the user's guide hand, forearm and upper arm, the user is prepared to train himself or herself in the proper mechanics of the guide hand during the entire shooting motion. The basketball training device not only restricts flexion and opposition of the thumb but it restricts pronation of the user's forearm. In addition, the basketball training device restricts flexion, extension, radial deviation, and ulnar deviation of the user's wrist while allowing the user appropriate extension at the elbow joint during the entire shooting motion.

Figure 1:
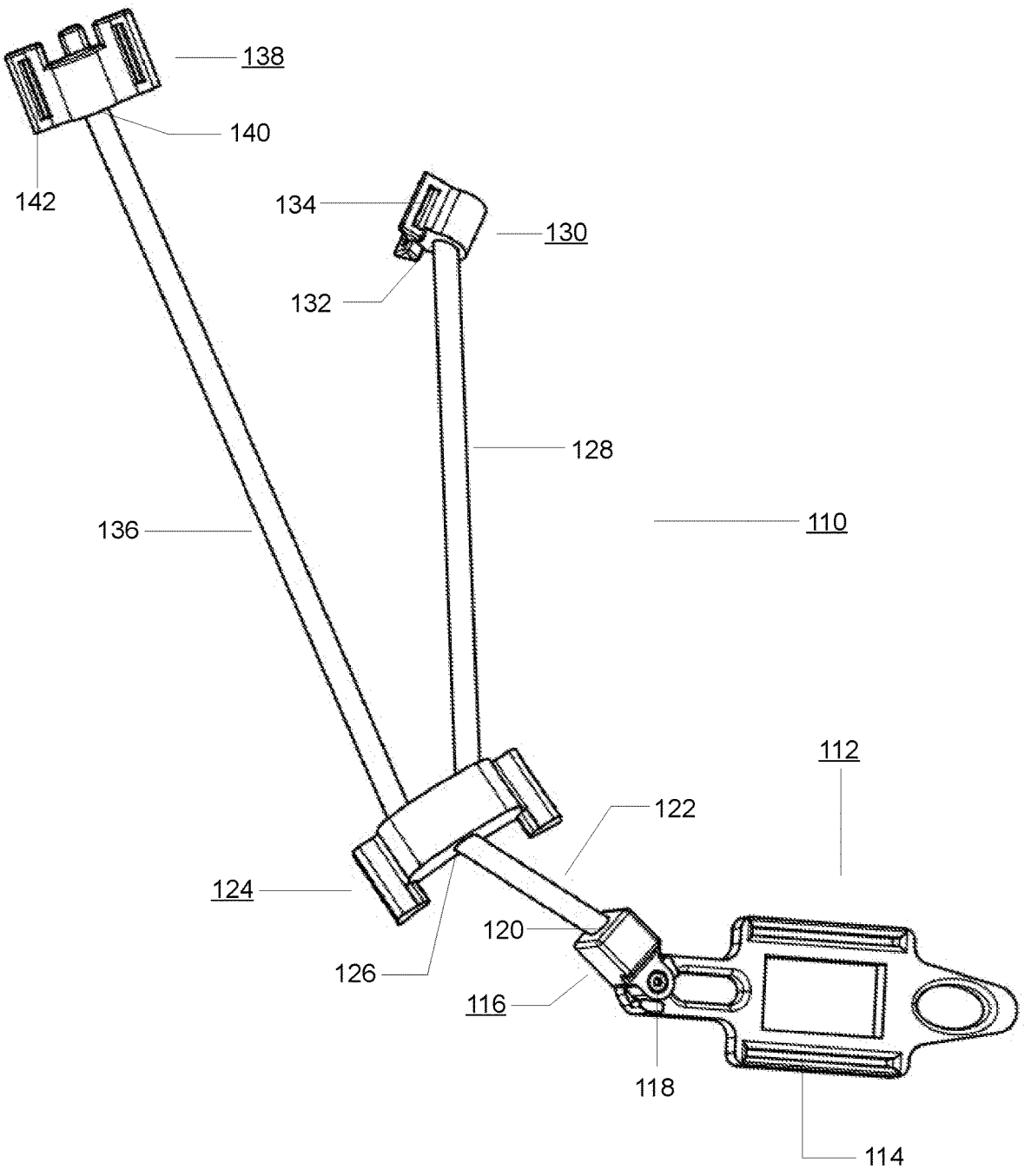
FIG. 1 is a perspective view of one embodiment of a basketball training device.

| REFERENCE NUMERALS FOR DRAWINGS (Please note that the first digit indicates the figure in which a component is first readily identifiable): | |
|---|---|
| 110 | Basketball training device |
| 112 | Upper arm component |
| 114 | Upper arm strap through-slot |
| 116 | Pivot component |
| 118 | Pivot screw |
| 120 | Pivot attachment point |
| 122 | First elongated coupling member |
| 124 | Forearm component |
| 126 | Proximal forearm attachment point |
| 128 | Second elongated coupling member |
| 130 | Thumb component |
| 132 | Thumb attachment point |
| 134 | Thumb strap through-slot |
| 136 | Third elongated coupling member |
| 138 | Finger component |
| 140 | Finger attachment point |
| 142 | Finger strap through-slot |
| 244 | Pivot nut |
| 246 | First distal forearm attachment point |

-continued

| REFERENCE NUMERALS FOR DRAWINGS (Please note that the first digit indicates the figure in which a component is first readily identifiable): | |
|---|---|
| 248 | Second distal forearm attachment point |
| 258 | Forearm strap through-slot |
| 310 | Basketball training device |
| 312 | Upper arm component |
| 314 | Upper arm strap through-slot |
| 316 | Pivot component |
| 318 | Pivot screw |
| 320 | Pivot attachment point |
| 322 | First elongated coupling member |
| 324 | Forearm component |
| 326 | Proximal forearm attachment point |
| 328 | Second elongated coupling member |
| 330 | Thumb component |
| 332 | Thumb attachment point |
| 334 | Thumb strap through-slot |
| 346 | Distal forearm attachment point |
| 410 | Basketball training device |
| 412 | Upper arm component |
| 414 | Upper arm strap through-slot |
| 416 | Pivot component |
| 418 | Pivot screw |
| 420 | Pivot attachment point |
| 422 | Elongated coupling member |
| 430 | Thumb component |
| 432 | Thumb attachment point |
| 434 | Thumb strap through-slot |
| 512 | Upper arm component |
| 514 | Upper arm strap through-slot |
| 516 | Pivot component |
| 518 | Pivot screw |
| 550 | Elbow flexion stop |
| 552 | Elbow extension stop |
| 612 | Upper arm component |
| 614 | Upper arm strap through-slot |
| 616 | Pivot component |
| 618 | Pivot screw |
| 644 | Pivot nut |
| 650 | Elbow flexion stop |
| 652 | Elbow extension stop |
| 654 | Integrated Pintle |
| 660 | Gudgeon |
| 712 | Upper arm component |
| 714 | Upper arm strap through-slot |
| 716 | Pivot component |
| 718 | Separate Pintle |
| 744 | Pivot nut |
| 750 | Elbow flexion stop |
| 752 | Elbow extension stop |
| 756 | Socket |
| 760 | Gudgeon |
| 810 | Basketball training device |
| 910 | Basketball training device |
| 962 | Upper arm strap |
| 964 | Forearm strap |
| 966 | Thumb strap |
| 968 | Finger strap |

DETAILED DESCRIPTION OF DRAWINGS

FIG. 1 illustrates a perspective view of one embodiment of a basketball training device 110. The basketball training device 110 comprises an upper arm component 112, a pivot component 116, a forearm component 124, a thumb component 130, a finger component 138, a first elongated coupling member 122, a second elongated coupling member 128, and a third elongated coupling member 136. The upper arm component 112 comprises at least one upper arm strap through-slot 114. An upper arm strap is fed through the upper arm through-slot 114, which allows the user to secure the upper arm component 112 to his or her upper arm. The pivot component 116 comprises a pivot attachment point 120. The pivot component 116 is pivotably connected to the upper arm component 112 using a pivot screw 118 and a corresponding pivot nut 244. The pivot screw 118 can be a fully-threaded screw, partially-threaded screw, shoulder screw, bolt, pin, or other suitable fastener. The pivot nut 244 is visualized better in FIG. 2. As such, the pivot component 116 is connected to and can rotate relative to the upper arm component 112.

The forearm component 124 comprises at least one forearm strap through-slot 258, a proximal forearm attachment point 126, a first distal forearm attachment point 246, and a second distal forearm attachment point 248. The forearm strap through-slot 258, the first distal forearm attachment point 246, and the second distal forearm attachment point 248 are each visualized better in FIG. 2. A forearm strap is fed through the forearm strap through-slot 258, which allows the user to secure the forearm component 124 to his or her forearm. The first elongated coupling member 122 is formed from a rigid material, such as fiberglass, aluminum, carbon fiber, or similarly rigid material. The first elongated coupling member 122 is attached at a proximal end to the pivot attachment point 120 and attached at a distal end to the proximal forearm attachment point 126. As such, the forearm component 124 is rigidly coupled to the pivot component 116. The pivot attachment point 120 and the proximal forearm attachment point 126 are both preferably sockets adapted for the insertion of the first elongated coupling member 122. The first elongated coupling member 122 is then secured in either socket using, preferably, an adhesive. However, other means, such as a set screw or other mechanical means, may be used to ensure that the first elongated coupling member 122 is secured within the socket.

The thumb component 130 comprises at least one thumb strap through-slot 134 and a thumb attachment point 132. A thumb strap is fed through the thumb strap through-slot 134, which allows the user to secure the thumb component 130 to his or her thumb. The second elongated coupling member 128, also formed from a rigid material, is attached at a distal end to the thumb attachment point 132 and attached at a proximal end to the first distal forearm attachment point 246. As such, the thumb component 130 is rigidly coupled to the forearm component 124. The thumb attachment point 132 and the first distal forearm attachment point 246 are both preferably sockets adapted for the insertion of the second elongated coupling member 128. The second elongated coupling member 128 is then secured in either socket using, preferably, an adhesive. However, other means, such as a set screw or other mechanical means, may be used to ensure that the second elongated coupling member 128 is secured within the socket.

The finger component 138 comprises at least one finger strap through-slot 142 and a finger attachment point 140. A finger strap is fed through the finger strap through-slot 142, which allows the user to secure the finger component 138 to his or her finger. The third elongated coupling member 136, also formed from a rigid material, is attached at a distal end to the finger attachment point 140 and attached at a proximal end to the second distal forearm attachment point 248. As such, the finger component 138 is rigidly coupled to the forearm component 124. The finger attachment point 140 and the second distal forearm attachment point 248 are both preferably sockets adapted for the insertion of the third elongated coupling member 136. The third elongated coupling member 136 is then secured in either socket using, preferably, an adhesive. However, other means, such as a set screw or other mechanical means, may be used to ensure that the third elongated coupling member 136 is secured within the socket.

Figure 2:
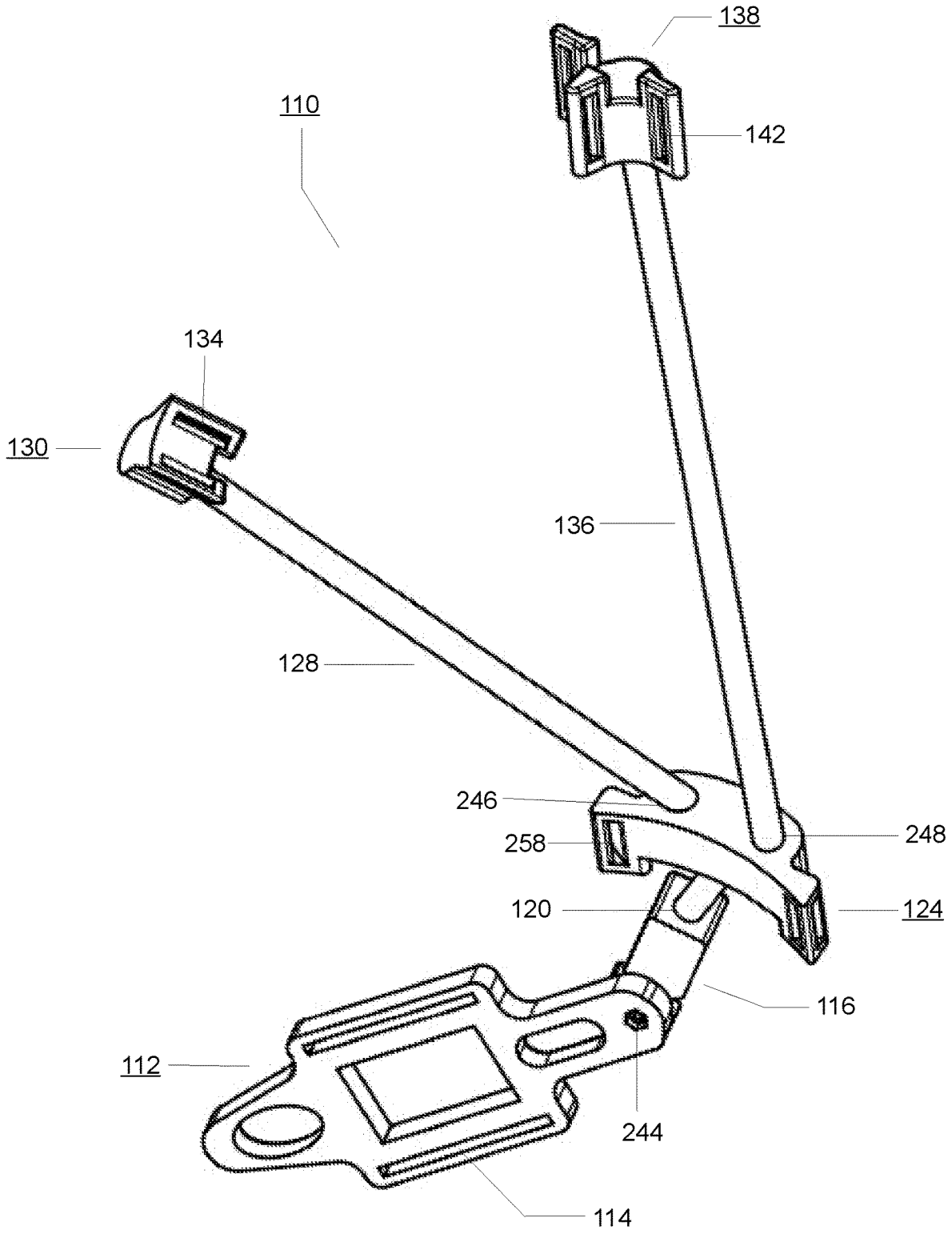
FIG. 2 is a perspective view of the embodiment depicted in FIG. 2, but from an opposing angle.

FIG. 2 is another perspective view, but from an opposing angle, of the embodiment illustrated in FIG. 1. The basketball training device 110 comprises and upper arm component 112, a pivot component 116, a forearm component 124, a thumb component 130, a finger component 138, a first elongated coupling member 122, a second elongated coupling member 128, and a third elongated coupling member 136. The upper arm component 112 comprises at least one upper arm strap through-slot 114. The pivot component 116 comprises a pivot attachment point 120. The pivot component 116 is pivotably connected to the upper arm component 112 using a pivot screw 120 and a corresponding pivot nut 244. As such, the pivot component 116 is connected to and can rotate relative to the upper arm component 112.

The forearm component 124 comprises a proximal forearm attachment point 126, a first distal forearm attachment point 246, and a second distal forearm attachment point 248. The proximal forearm attachment point 126 is visualized better in FIG. 1. The first elongated coupling member 122 is attached at a proximal end to the pivot attachment point 120 and attached at a distal end to the proximal forearm attachment point 126. As such, the forearm component 124 is rigidly coupled to the pivot component 116.

The thumb component 130 comprises at least one thumb strap through-slot 134 and a thumb attachment point 132. The thumb attachment point 132 is visualized better in FIG. 1. The second elongated coupling member 128 is attached at a distal end to the thumb attachment point 132 and attached at a proximal end to the first distal forearm attachment point 246. As such, the thumb component 130 is rigidly coupled to the forearm component 124. The finger component 138 comprises at least one finger strap through-slot 142 and a finger attachment point 140. The finger attachment point 140 is visualized better in FIG. 1. The third elongated coupling member 136 is attached at a distal end to the finger attachment point 140 and attached at a proximal end to the second distal forearm attachment point 248. As such, the finger component 138 is rigidly coupled to the forearm component 124.

Figure 3:
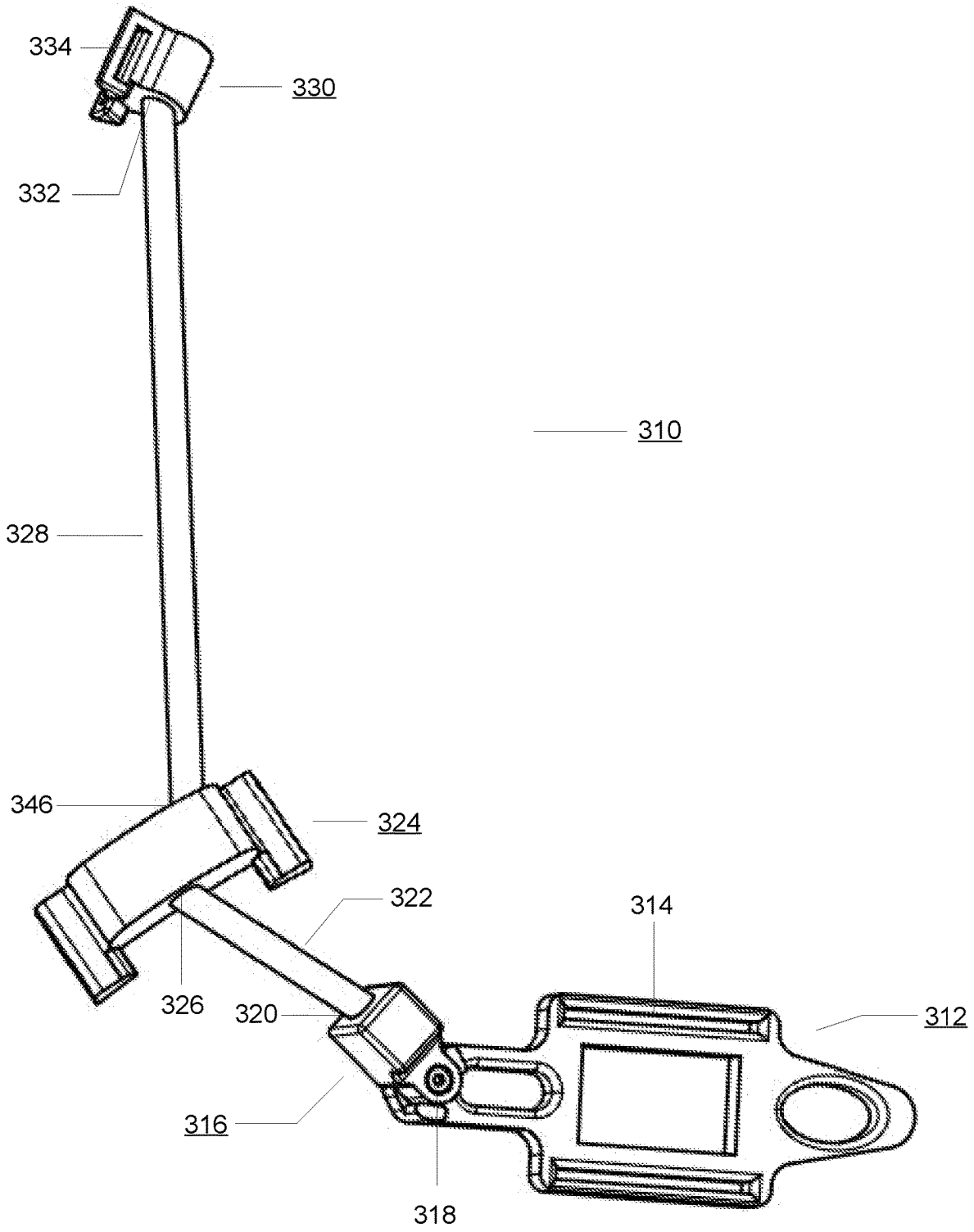
FIG. 3 is a perspective view of another embodiment of a basketball training device having no finger component.

FIG. 3 is a perspective view of another embodiment of a basketball training device 310. The basketball training device 310 comprises an upper arm component 312, a pivot component 316, a forearm component 324, a thumb component 330, a first elongated coupling member 322, and a second elongated coupling member 328. The upper arm component comprises at least one upper arm strap through-slot 314. The pivot component 316 comprises a pivot attachment point 320. The forearm component 324 comprises at least one forearm strap through-slot 258, a proximal forearm attachment point 326, and a distal forearm attachment point 346. An embodiment of the forearm strap through-slot 258 is visualized better in FIG. 2. The thumb component 330 comprises at least one thumb strap through-slot 334 and a thumb attachment point 332.

The pivot component 316 is pivotably connected to the upper arm component 312 using a pivot screw 318 and a pivot nut 244. An embodiment of the pivot nut 244 is visualized better in FIG. 2. As such, the pivot component 316 is connected to and can rotate relative to the upper arm component 312. The first elongated coupling member 322 is formed from a rigid material, such as fiberglass, aluminum, carbon fiber, or similarly rigid material. The first elongated coupling member 322 is attached at a proximal end to the pivot attachment point 320 and attached at a distal end to the proximal forearm attachment point 326. As such, the forearm component 324 is rigidly coupled to the pivot component 316. The second elongated coupling member 328, also formed from a rigid material, is attached at a proximal end to the distal forearm attachment point 346 and attached at a distal end to the thumb attachment point 332. As such, the thumb component 330 is rigidly coupled to the forearm component 324.

Figure 4:
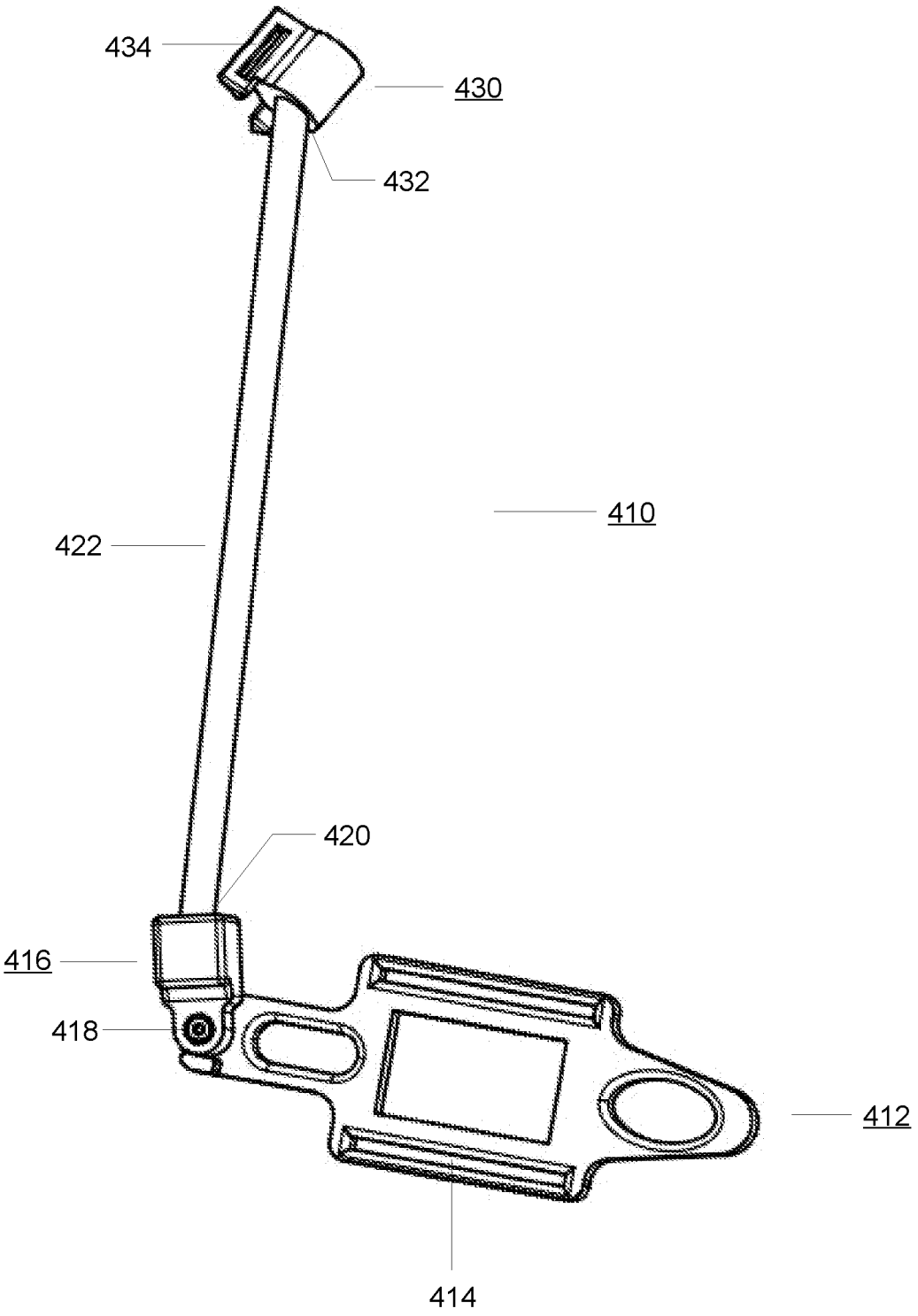
FIG. 4 is a perspective view of another embodiment of a basketball training device having no finger component and no forearm component.

FIG. 4 is a perspective view of another embodiment of a basketball training device 410. The basketball training device 410 comprises an upper arm component 412, a pivot component 416, a thumb component 430, and an elongated coupling member 422. The upper arm component 412 comprises at least one upper arm strap through-slot 414. The pivot component 416 comprises a pivot attachment point 420. The thumb component 430 comprises at least one thumb strap through-slot 434 and a thumb attachment point 432.

The pivot component 416 is pivotably connected to the upper arm component 412 using a pivot screw 418 and a pivot nut 244. An embodiment of the pivot nut 244 is visualized better in FIG. 2. As such, the pivot component 416 is connected to and can rotate relative to the upper arm component 412. The elongated coupling member 422, formed from a rigid material such as fiberglass, aluminum, or carbon fiber, is attached at a proximal end to the pivot attachment point 420 and attached at a distal end to the thumb attachment point 432. As such, the thumb component 430 is rigidly coupled to the pivot component 416.

Figure 5:
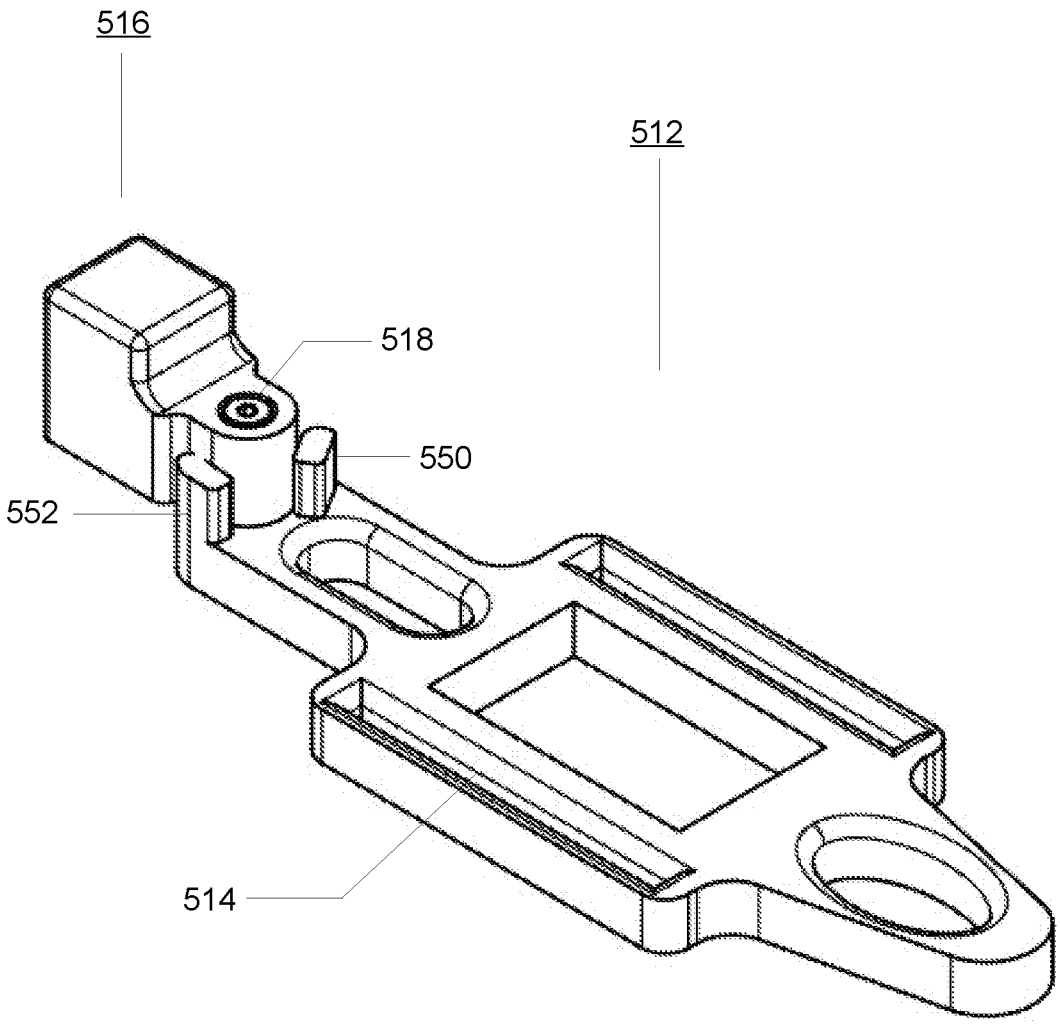
FIG. 5 is a perspective view of one embodiment of an upper arm component with both an elbow extension stop and an elbow flexion stop, as well as an associated pivot component.

FIG. 5 is a perspective view of one embodiment of an upper arm component 512 and a pivot component 516. The upper arm component 512 comprises an elbow flexion stop 550 and an elbow extension stop 552. The pivot component 516 is pivotably connected to the upper arm component 512 using a pivot screw 518 and a pivot nut 644. The pivot nut 644 is visualized better in FIG. 6. As such, the pivot component 516 is connected to and can rotate relative to the upper arm component 512. However, the elbow flexion stop 550 is positioned on the upper arm component 512 to limit clockwise rotation of the pivot component 516 and the elbow extension stop 552 is positioned on the upper arm component 512 to limit counterclockwise rotation of the pivot component 516. It should be noted, while it is preferred that the upper arm component 512 comprise both the elbow flexion stop 550 and the elbow extension stop 552, that either stop or both stops can be removed and the basketball training device will remain effective.

Figure 6:
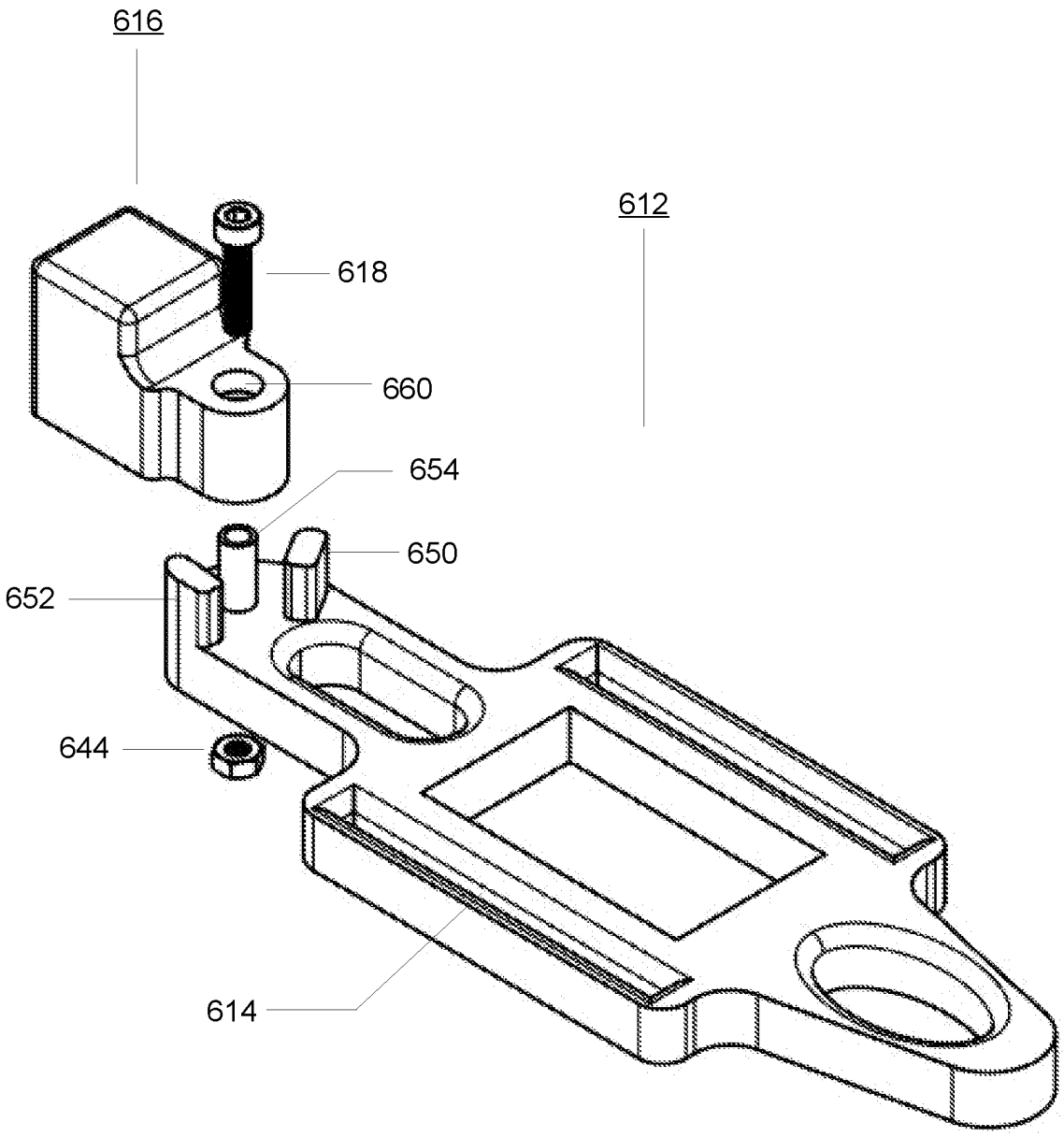
FIG. 6. is an exploded perspective view of one embodiment of an upper arm component with both an elbow extension stop and an elbow flexion stop, as well as an associated pivot component.

FIG. 6 is an exploded perspective view of one embodiment of an upper arm component 612 and a pivot component 616. An upper arm component 612 comprises an integrated pintle 654, an elbow flexion stop 650, and an elbow extension stop 652. The pivot component 616 comprises a gudgeon 660, which is pivotably connected to the integrated pintle 654 of the upper arm component 612 using a pivot screw 618 and a pivot nut 644. As such, the pivot component 616 is connected to and can rotate relative to a central axis of the integrated pintle 654. However, the elbow flexion stop 650 is positioned on the upper arm component 612 to limit clockwise rotation of the pivot component 616 and the elbow extension stop 652 is positioned on the upper arm component 612 to limit counterclockwise rotation of the pivot component 616.

Figure 7:
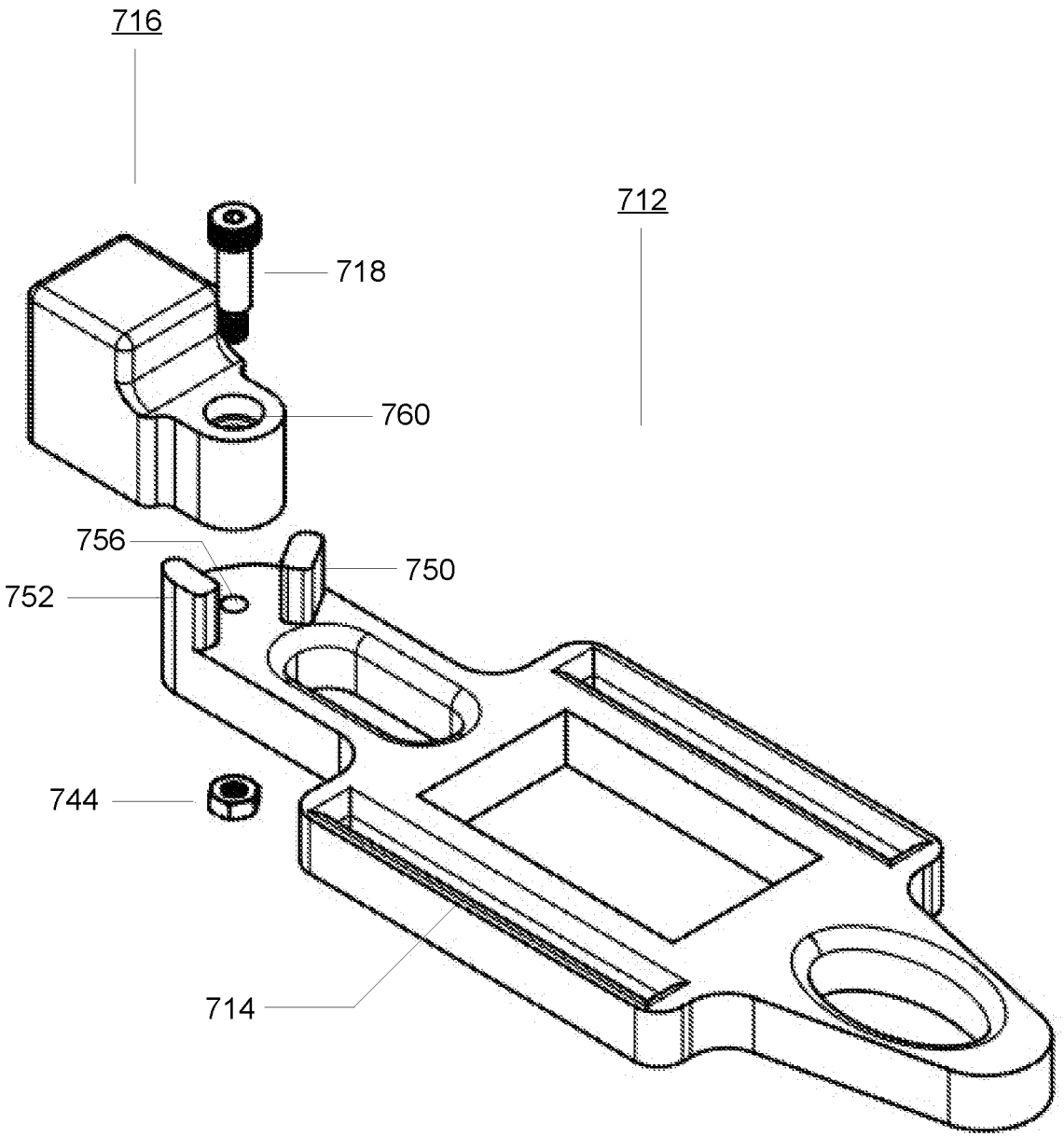
FIG. 7 is an exploded perspective view of another embodiment of an upper arm component with both an elbow extension stop and an elbow flexion stop, as well as an associated pivot component.

FIG. 7 is an exploded perspective view of another embodiment of an upper arm component 712 and a pivot component 716. An upper arm component 712 comprises a socket 756, an elbow flexion stop 750, and an elbow extension stop 752. The pivot component 716 comprises a gudgeon 760, which is pivotably connected to the socket 756 of the upper arm component 712 using a separate pintle 718 and a pivot nut 744. It should be noted that the separate pintle 718 can be a fully-threaded screw, partially-threaded screw, shoulder screw, bolt, pin, or other suitable fastener. As such, the pivot component 716 is connected to and can rotate relative to a central axis of the socket 756. However, the elbow flexion stop 750 is positioned on the upper arm component 712 to limit clockwise rotation of the pivot component 716 and the elbow extension stop 752 is positioned on the upper arm component 712 to limit counterclockwise rotation of the pivot component 716.

Figure 8:
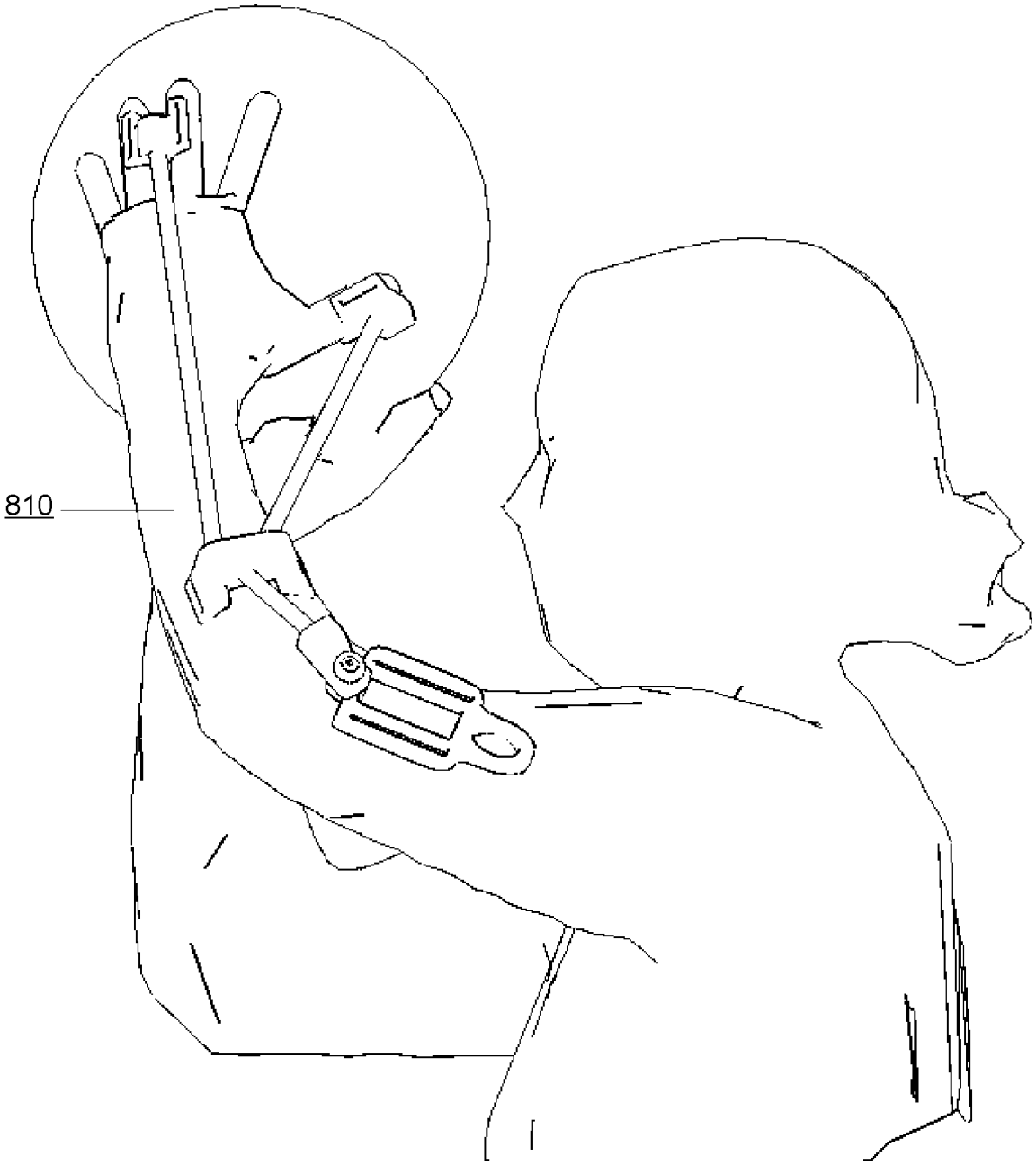
FIG. 8 is a perspective view of one embodiment of the training device positioned on a user's arm and hand.

FIG. 8 is a perspective view of one embodiment of a basketball training device 810 positioned on a user's arm and hand. While the associated straps are not depicted here, the basketball training device 810 is preferably secured by way of adjustable straps to the user's upper arm, user's forearm, user's thumb, and at least one of the user's fingers.

Figure 9:
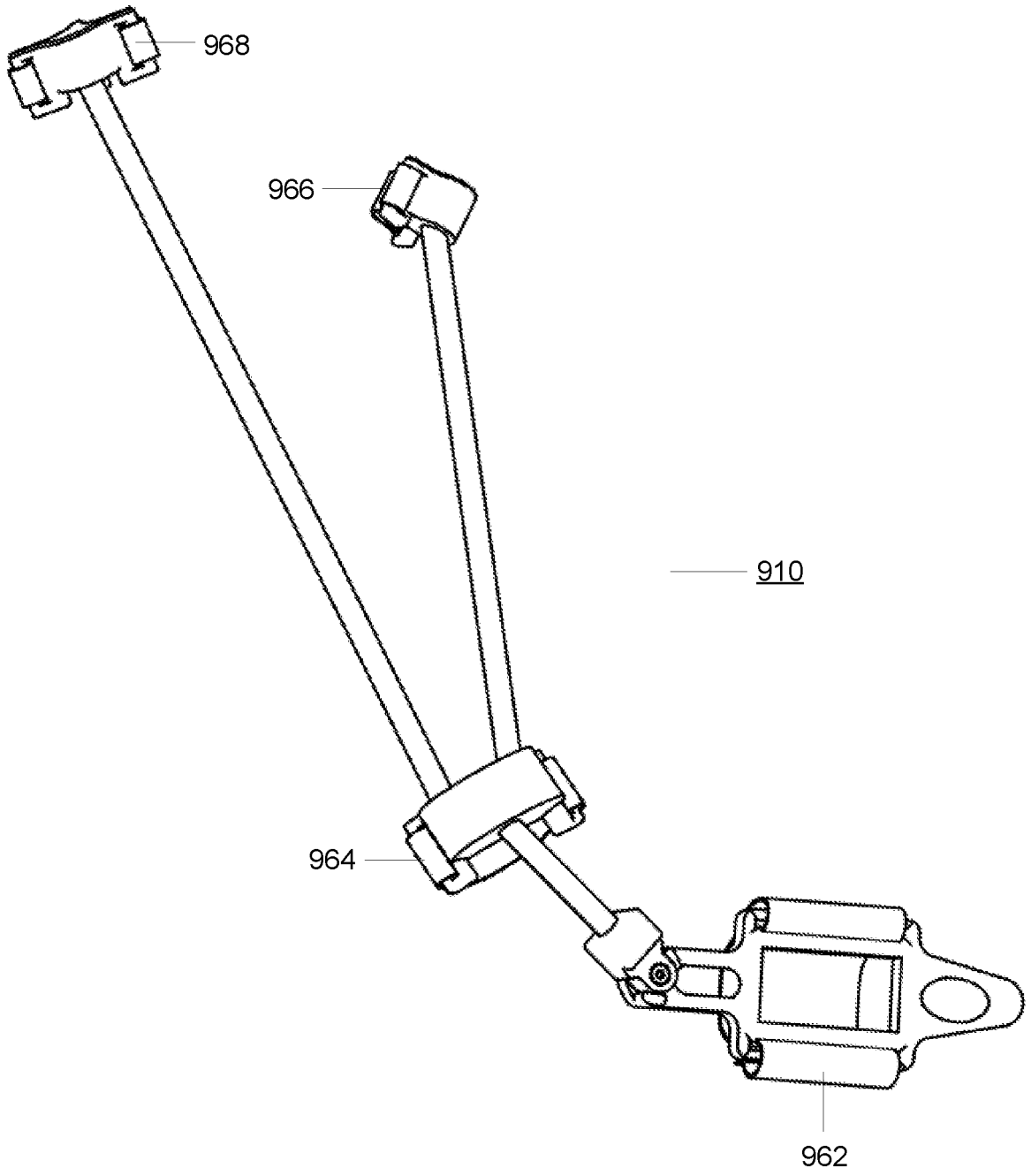
FIG. 9 is a perspective view of one embodiment of the training device with the associated upper arm, forearm, thumb, and finger straps.

FIG. 9 is a perspective view of one embodiment of a basketball training device 910, which includes an upper arm strap 962, a forearm strap 964, a thumb strap 966, and a finger strap 968. Adjustable straps, which are preferable, are used to secure the basketball training device 910 to the user.

While specific embodiments and applications of the present invention have been described herein, it will be apparent to those of ordinary skill in the art that many variations on the embodiments and applications described are possible without departing from the scope of the invention. It should be understood that while certain embodiments of the invention have been shown and described, the invention is not to be limited to the specific embodiments described and illustrated.

The invention claimed is:

1. A basketball training device for a user's guide hand, comprising:

an upper arm component comprising at least one upper arm strap through-slot and a socket;

an upper arm strap attached to said at least one upper arm strap through-slot, said upper arm component configured to be secured to a user's upper arm with said upper arm strap;

a pivot component comprising a pivot attachment point and a gudgeon;

a separate pintle, said separate pintle pivotably connecting said gudgeon to said socket;

a forearm component comprising at least one forearm strap through-slot, a proximal forearm attachment point, and a first distal forearm attachment point;

a forearm strap attached to said at least one forearm strap through-slot, said forearm component configured to be secured to a user's forearm with said forearm strap;

a first elongated coupling member formed from a rigid material, said first elongated coupling member comprising a first distal end and a first proximal end, said first distal end attached to said proximal forearm attachment point and said first proximal end attached to said pivot attachment point;

a thumb component comprising at least one thumb strap through-slot and a thumb attachment point, a thumb strap attached to said at least one thumb strap through-slot, said thumb component configured to be secured to a user's thumb with said thumb strap; and a second elongated coupling member formed from a rigid material, said second elongated coupling member comprising a second distal end and a second proximal end, said second distal end attached to said thumb attachment point and said second proximal end attached to said first distal forearm attachment point;

whereby said upper arm component is configured to be secured to said user's upper arm, said pivot component is pivotably connected to said upper arm component, said pivot component is coupled to said forearm component by way of said first elongated coupling member, said forearm component is configured to be secured to said user's forearm, said forearm component is coupled to said thumb component by way of said second elongated coupling member, and said thumb component is configured to be secured to said user's thumb.

2. The basketball training device of claim 1 further comprising:

at least one of an elbow flexion stop and an elbow extension stop;

whereby said at least one of said elbow flexion stop and said elbow extension stop is configured to limit at least one of a user's elbow flexion and a user's elbow extension.

3. The basketball training device of claim 1 further comprising:

a finger component comprising at least one finger strap through-slot and a finger attachment point;

a finger strap attached to said at least one finger strap through-slot, said finger component configured to be secured to at least one of a user's fingers with said finger strap;

said forearm component further comprising a second distal forearm attachment point; and a third elongated coupling member formed from a rigid material, said third elongated coupling member comprising a third distal end and a third proximal end, said third distal end attached to said finger attachment point and said third proximal end attached to said second distal forearm attachment point;

whereby said upper arm component is configured to be secured to the user's upper arm, said pivot component is pivotably connected to said upper arm component, said pivot component is coupled to said forearm component by way of said first elongated coupling member, said forearm component is configured to be secured to said user's forearm, said forearm component is coupled to said thumb component by way of said second elongated coupling member, said thumb component is configured to be secured to said user's thumb, said finger component is coupled to said forearm component by way of said third elongated coupling member, and said finger component is configured to be secured to said at least one of the user's fingers.

4. The basketball training device of claim 3 further comprising:

at least one of an elbow flexion stop and an elbow extension stop;

whereby said at least one of said elbow flexion stop and said elbow extension stop is configured to limit at least one of a user's elbow flexion and a user's elbow extension.

5. A basketball training device for a user's guide hand, comprising:

an upper arm component comprising at least one upper arm strap through-slot and an integrated pintle;

an upper arm strap attached to said at least one upper arm strap through-slot, said upper arm component configured to be secured to a user's upper arm with said upper arm strap;

a pivot component comprising a pivot attachment point and a gudgeon, said gudgeon pivotably connected to said integrated pintle of said upper arm component;

a forearm component comprising at least one forearm strap through-slot, a proximal forearm attachment point, and a first distal forearm attachment point;

a forearm strap attached to said at least one forearm strap through-slot, said forearm component configured to be secured to a user's forearm with said forearm strap;

a first elongated coupling member formed from a rigid material, said first elongated coupling member comprising a first distal end and a first proximal end, said first distal end attached to said proximal forearm attachment point and said first proximal end attached to said pivot attachment point;

a thumb component comprising at least one thumb strap through-slot and a thumb attachment point, a thumb strap attached to said at least one thumb strap through-slot, said thumb component configured to be secured to a user's thumb with said thumb strap; and a second elongated coupling member formed from a rigid material, said second elongated coupling member comprising a second distal end and a second proximal end, said second distal end attached to said thumb attachment point and said second proximal end attached to said first distal forearm attachment point;

whereby said upper arm component is configured to be secured to said user's upper arm, said pivot component is pivotably connected to said upper arm component, said pivot component is coupled to said forearm component by way of said first elongated coupling member, said forearm component is configured to be secured to said user's forearm, said forearm component is coupled to said thumb component by way of said second elongated coupling member, and said thumb component is configured to be secured to said user's thumb.

6. The basketball training device of claim 5 further comprising:

at least one of an elbow flexion stop and an elbow extension stop;

whereby said at least one of said elbow flexion stop and said elbow extension stop is configured to limit at least one of a user's elbow flexion and a user's elbow extension.

7. The basketball training device of claim 5 further comprising:

a finger component comprising at least one finger strap through-slot and a finger attachment point;

a finger strap attached to said at least one finger strap through-slot, said finger component configured to be secured to at least one of a user's fingers with said finger strap;

said forearm component further comprising a second distal forearm attachment point; and a third elongated coupling member formed from a rigid material, said third elongated coupling member comprising a third distal end and a third proximal end, said third distal end attached to said finger attachment point and said third proximal end attached to said second distal forearm attachment point;

whereby said upper arm component is configured to be secured to the user's upper arm, said pivot component is pivotably connected to said upper arm component, said pivot component is coupled to said forearm component by way of said first elongated coupling member, said forearm component is configured to be secured to said user's forearm, said forearm component is coupled to said thumb component by way of said second elongated coupling member, said thumb component is configured to be secured to said user's thumb, said finger component is coupled to said forearm component by way of said third elongated coupling member, and said finger component is configured to be secured to said at least one of the user's fingers.

8. The basketball training device of claim 7 further comprising:

at least one of an elbow flexion stop and an elbow extension stop;

whereby said at least one of said elbow flexion stop and said elbow extension stop is configured to limit at least one of a user's elbow flexion and a user's elbow extension.

* * * * *